US009359828B2

(12) United States Patent
Scott

(10) Patent No.: US 9,359,828 B2
(45) Date of Patent: Jun. 7, 2016

(54) SELF-SHARPENING CUTTING ELEMENTS, EARTH-BORING TOOLS INCLUDING SUCH CUTTING ELEMENTS, AND METHODS OF FORMING SUCH CUTTING ELEMENTS

(71) Applicant: Baker Hughes Incorporated, Houston, TX (US)

(72) Inventor: Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 354 days.

(21) Appl. No.: 13/794,187

(22) Filed: Mar. 11, 2013

(65) Prior Publication Data

US 2013/0248259 A1 Sep. 26, 2013

Related U.S. Application Data

(60) Provisional application No. 61/613,846, filed on Mar. 21, 2012, provisional application No. 61/619,121, filed on Apr. 2, 2012.

(51) Int. Cl.

| | |
|---|---|
| ***E21B 10/46*** | (2006.01) |
| ***E21B 10/573*** | (2006.01) |
| ***E21B 10/00*** | (2006.01) |

(52) U.S. Cl.

CPC ..... *E21B 10/573* (2013.01); *E21B 10/006* (2013.01)

(58) Field of Classification Search

CPC ..... E21B 10/46; E21B 2010/561; E21B 2010/564; E21B 2010/565; E21B 10/567; E21B 10/573; C22C 19/00; C22C 19/07

See application file for complete search history.

(56) References Cited

U.S. PATENT DOCUMENTS

| | | | | |
|---|---|---|---|---|
| 2,026,760 | A * | 1/1936 | Turner | 369/173 |
| 5,135,061 | A | 8/1992 | Newton | |
| 6,425,922 | B1 | 7/2002 | Pope et al. | |
| 7,070,635 | B2 | 7/2006 | Frushour | |
| 7,396,501 | B2 | 7/2008 | Pope et al. | |
| 7,487,849 | B2 | 2/2009 | Radtke | |
| 7,556,668 | B2 | 7/2009 | Eason et al. | |
| 7,556,763 | B2 | 7/2009 | Pope et al. | |

(Continued)

OTHER PUBLICATIONS

International Search Report for International Application No. PCT/US2013/033217 dated Jun. 26, 2013, 4 pages.

(Continued)

*Primary Examiner* — Cathleen Hutchins
(74) *Attorney, Agent, or Firm* — TraskBritt

(57) ABSTRACT

Cutting elements for earth-boring tools comprise a substrate including at least one material selected from the group consisting of CoCr, CoCrMo, CoCrW, and Ti. A polycrystalline superabrasive material may be attached to the substrate. Earth-boring tools comprise a body. At least one cutting element is attached to the body. The at least one cutting element comprises a substrate including at least one material selected from the group consisting of CoCr, CoCrMo, CoCrW, and Ti. A polycrystalline superabrasive material may be attached to the substrate. Methods of forming cutting elements for earth-boring tools comprise disposing a substrate including at least one material selected from the group consisting of CoCr, CoCrMo, CoCrW, and Ti in a container. Particles of superabrasive material may be disposed in the container. The particles of superabrasive material may be sintered with the substrate in the container to form a polycrystalline superabrasive material attached to the substrate.

21 Claims, 4 Drawing Sheets

(56) References Cited

U.S. PATENT DOCUMENTS

| | | | | |
|---|---|---|---|---|
| 7,753,143 | B1 * | 7/2010 | Miess et al. | 175/374 |
| 7,971,663 | B1 * | 7/2011 | Vail | 175/428 |
| 8,109,350 | B2 | 2/2012 | Fang et al. | |
| 2001/0000101 | A1 * | 4/2001 | Lovato E21B | 10/5735 175/425 |
| 2009/0218146 | A1 * | 9/2009 | Fang et al. | 175/428 |
| 2011/0024200 | A1 | 2/2011 | DiGiovanni et al. | |
| 2011/0042148 | A1 | 2/2011 | Schmitz et al. | |
| 2011/0088950 | A1 | 4/2011 | Scott et al. | |
| 2012/0325563 | A1 | 12/2012 | Scott et al. | |

OTHER PUBLICATIONS

International Written Opinion for International Application No. PCT/US2013/033217 dated Jun. 26, 2013, 7 pages.

International Preliminary Report on Patentability for International Application No. PCT/US2013/033217 dated Sep. 23, 2014, 8 pages.

* cited by examiner

SELF-SHARPENING CUTTING ELEMENTS, EARTH-BORING TOOLS INCLUDING SUCH CUTTING ELEMENTS, AND METHODS OF FORMING SUCH CUTTING ELEMENTS

CROSS-REFERENCE TO RELATED APPLICATIONS

This application claims the benefit of U.S. Provisional patent application Ser. No. 61/613,846, filed Mar. 21, 2012, and of U.S. Provisional patent application Ser. No. 61/619,121, filed Apr. 2, 2012, the disclosure of each of which is incorporated herein in its entirety by this reference.

FIELD

The disclosure relates generally to cutting elements for earth-boring tools. More specifically, the disclosed embodiments relate to cutting elements that may be self-sharpening, earth-boring tools including such self-sharpening cutting elements, and methods of forming self-sharpening cutting elements.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high-temperature/high-pressure (or "HTHP") processes. The cutting element substrate may comprise a cermet material (i.e., a ceramic-metal composite material) such as cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

PDC cutting elements commonly have a planar, disc-shaped diamond table on an end surface of a cylindrical cemented carbide substrate. Such a PDC cutting element may be mounted to an earth-boring rotary drag bit or other tool using fixed PDC cutting elements in a position and orientation that causes a peripheral edge of the diamond table to scrape against and shear away the surface of the formation being cut as the drill bit is rotated within a wellbore. As the PDC cutting element wears, a so-called "wear scar" or "wear flat" develops that comprises a generally flat surface of the cutting element that ultimately may extend from the front, exposed major surface of the diamond table to the cylindrical lateral side surface of the cemented carbide substrate.

Early PDC cutting elements had relatively thinner diamond tables having an average thickness of about one (1) millimeter or less. As such cutting elements were used to cut formation material, the wear scar that developed often included an uneven profile wherein the surface of the diamond table that was rubbing against the formation projected outward from the cutting element beyond the adjacent surface of the cemented carbide substrate that was rubbing against the formation. It was believed that this phenomenon was due to the fact that the rubbing surface of the cemented carbide substrate was wearing at a faster rate than was the rubbing surface of the diamond table. The portion of the diamond table at the wear scar projecting outward beyond the adjacent rubbing surface of the cemented carbide substrate has been referred to as a "shear lip." The formation of such a shear lip may beneficially result in an increased rate of penetration (ROP).

BRIEF SUMMARY

In some embodiments, cutting elements for earth-boring tools comprise a substrate comprising at least one material selected from the group consisting of CoCr, CoCrMo, CoCrW, and Ti. A polycrystalline superabrasive material may be attached to the substrate.

In other embodiments, earth-boring tools comprise a body. At least one cutting element is attached to the body. The at least one cutting element comprises or the cutting elements comprise a substrate comprising at least one material selected from the group consisting of CoCr, CoCrMo, CoCrW, and Ti. A polycrystalline superabrasive material may be attached to the substrate.

In still other embodiments, methods of foci ling cutting elements for earth-boring tools comprise disposing a substrate comprising at least one material selected from the group consisting of CoCr, CoCrMo, CoCrW, and Ti in a container. Particles of superabrasive material may be disposed in the container. The particles of superabrasive material may be sintered with the substrate in the container to form a polycrystalline superabrasive material attached to the substrate.

BRIEF DESCRIPTION OF THE DRAWINGS

While the specification concludes with claims particularly pointing out and distinctly claiming what are regarded as embodiments of the invention, various features and advantages of disclosed embodiments may be more readily ascertained from the following description when read in conjunction with the accompanying drawings, in which:

DETAILED DESCRIPTION

The illustrations presented herein are not meant to be actual views of any particular cutting element, container, earth-boring tool, or component thereof, but are merely idealized representations employed to describe illustrative embodiments. Thus, the drawings are not necessarily to scale. Additionally, elements common between figures may retain the same or similar numerical designation.

Disclosed embodiments relate generally to cutting elements that may be self-sharpening. More specifically, disclosed are cutting element substrates that may comprise, for example, at least one of CoCr, CoCrMo, CoCrW, and elemental Ti, which may enable the cutting elements including such substrates to be self-sharpening.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "polycrystalline material" means and includes any material comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "inter-bonded" mean and include any direct atomic bond (e.g., covalent, ionic, etc.) between atoms in adjacent grains of superabrasive material.

The term "sintering," as used herein, means temperature driven mass transport resulting in densification of a particulate component, and typically involves removal of at least a portion of the pores between the starting particles (accompanied by shrinkage) combined with coalescence and bonding among adjacent particles.

As used herein, the term "material composition" means the chemical composition and microstructure of a material. In other words, materials having the same chemical composition but a different microstructure having different material compositions.

Figure 1:
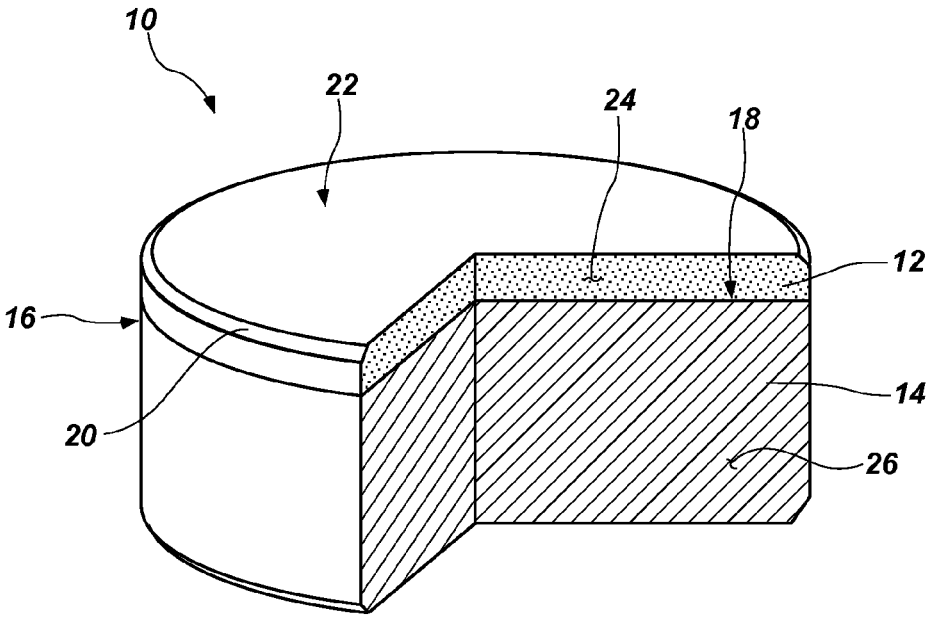
FIG. 1 is a partial cutaway perspective view of a cutting element for an earth-boring tool.

Referring to FIG. 1, a partial cutaway perspective view of a cutting element 10 for an earth-boring tool is shown. The cutting element 10 may include a cutting table 12 attached to a substrate 14. For example, the cutting element 10 may include a disc-shaped cutting table 12 attached to an end 16 of a cylindrical substrate 14 at an interface 18. In some embodiments, the cutting table 12 may be bonded directly to the substrate 14. The cutting table 12 may include a chamfer 20 extending along at least a portion of a periphery of the cutting table 12 in some embodiments. The cutting table 12 may define a cutting face 22, which may be configured to engage and remove an underlying earth formation primarily by a shearing or scraping cutting action. For example, the cutting face 22 may be planar in some embodiments.

A material 24 of the cutting table 12 may comprise a polycrystalline superabrasive material. For example, the material 24 of the cutting table 12 may comprise polycrystalline diamond (e.g., synthetic diamond, natural diamond, or synthetic and natural diamond), cubic boron nitride, carbon nitrides, boron carbon nitride, and other polycrystalline superabrasive materials known in the art.

A material 26 of the substrate 14 may wear at a faster rate than cobalt-cemented tungsten carbide. For example, the material 26 of the substrate 14 may comprise a metal, a metal alloy, or a particle matrix composite. More specifically, the substrate 14 may comprise, for example, at least one material 26 selected from the group consisting of CoCr, CoCrMo, CoCrW, and Ti. A substrate 14 comprising CoCr may comprise, for example, ASTM F-799, ASTM F-90, ASTM F-75, or ASTM F-562. A substrate 14 comprising Ti may comprise, for example, commercially pure Ti, Ti6A14V, ASTM F-1313, ASTM F-620, ASTM F-1580, TiMbHf, or Nitinol. The substrate 14 may enable the cutting element 10 to be self-sharpening due, at least in part, to the relatively high wear rate of the substrate 14 during cutting action, as discussed below with reference to FIG. 6.

Figure 6:
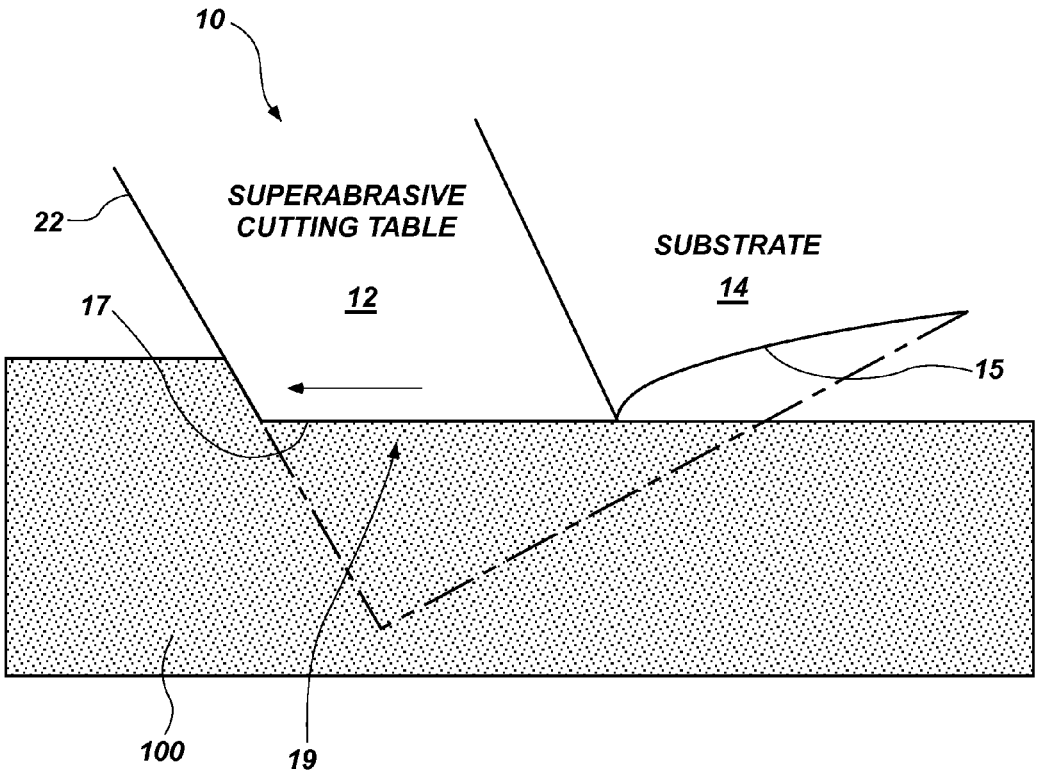
FIG. 6 is a simplified and schematically illustrated cross-sectional view illustrating a cutting element like that shown in FIG. 1 cutting through a formation.

FIG. 6 is a simplified and schematically illustrated cross-sectional view illustrating the cutting element 10 of FIG. 1 cutting through a formation material 100. The cutting element 10 is shown moving from right to left from the perspective of FIG. 6, as indicated by the directional arrow. The dashed lines in FIG. 6 illustrate the profile of the cutting element 10 in a new, sharp, unworn condition. After use of the cutting element 10, a wear flat 17 may develop, as shown in FIG. 6. The wear flat 17 extends from the cutting face 22 toward the interface between the cutting table 12 and the substrate 14. As shown in FIG. 6, a lateral side surface 15 of the substrate 14 may wear away behind the wear flat 17 on the cutting table 12, thus maintaining a sharp cutting edge or "shear lip" 19 comprising the portion of the cutting table 12 that extends into the formation material 100. In other words, the substrate 14 wears away behind the wear flat 17 during drilling, thus providing a relief between the formation 100 and the lateral side surface 15 of the substrate 14. In the event that the cutting edge or shear lip 19 chips or spalls, the lateral side surface 15 of the substrate 14 may again engage the formation 100, but may wear away at a relatively fast rate so as to re-sharpen the cutting edge or shear lip 19 response to continued cutting action. By employing a substrate 14 comprising a material that wears at a faster rate than cobalt-cemented tungsten carbide, the substrate 14 may wear away more quickly after chipping or spalling of the cutting table 12 has occurred, which may present a fresh cutting edge of the cutting table 12 for engagement with an underlying earth formation.

In previously known cutting elements comprising cobalt-cemented tungsten carbide substrates, the relatively high wear resistance of the cobalt-cemented tungsten carbide may cause the cutting element to present a dull cutting edge upon wear of the cutting element to a degree, and/or after chipping or spalling of the cutting table has occurred. As a result, the weight-on-bit (WOB) required to maintain a given depth-of-cut may increase, and/or a torque required to continue rotating an earth-boring tool to which the cutting element is attached may increase, even to the point where the earth-boring tool may become stuck or jammed in the wellbore and require expensive and time-consuming removal techniques.

Referring again to FIG. 1, the material 26 of the substrate 14 may be suitable for synthesis of a cutting table 12 comprising a polycrystalline superabrasive material 24 thereon. For example, the material 26 of the substrate 14 may be subjected to a high temperature/high pressure (HTHP) to form a cutting table 12 comprising polycrystalline superabrasive material 24 and attach the cutting table 12 to the substrate 14. The material 26 of the substrate 14 may not inherently significantly reduce the quality of the polycrystalline superabrasive material 24 or the quality of the attachment of the cutting table 12 to the substrate 14 as compared to the quality of polycrystalline superabrasive materials and attachments of cutting tables to substrates where the substrates comprise cobalt-cemented tungsten carbide. For example, a strength at high temperatures and a melting temperature of the material 26 of the substrate 14 may be sufficiently high that the substrate 14 is not destroyed during an HTHP process employed in formation on substrate 14 of an adequate polycrystalline superabrasive material 24 for earth-boring applications.

In some embodiments, the substrate 14 may be at least substantially free of particle-matrix composite material. When it is said that the substrate 14 may be at least substantially free of particle-matrix composite material, it is meant that the material 26 of the substrate 14 may be free of particle-matrix composite material other than particle-matrix composite materials that may be inherently formed by the material 24 of the cutting table 12 and the material 26 of the substrate 14 during formation of the cutting element 10 by, for example, migration of particles from the material 24 of the cutting table 12 into the material 26 of the substrate 14 proximate the interface 18. For example, the substrate 14 may comprise a metal or a metal alloy. More specifically, the substrate 14 may comprise, for example, a material 26 comprising at least one metal or metal alloy selected from the group consisting of CoCr, CoCrMo, CoCrW, Ti, and alloys thereof.

In some embodiments, the substrate 14 may comprise a particle-matrix composite material. In such embodiments, the matrix of the particle-matrix composite material may comprise, for example, a material selected from the group consisting of CoCr, CoCrMo, CoCrW, and Ti, such as, for example, any of the alloys discussed previously herein. The particles dispersed among the matrix of the particle-matrix composite material may comprise hard ceramics, such as, for example, carbides and borides made from elements such as W, Ti, Mo, Nb, V, Hf, Ta, Cr, Zr, Al, and Si.

Figure 2:
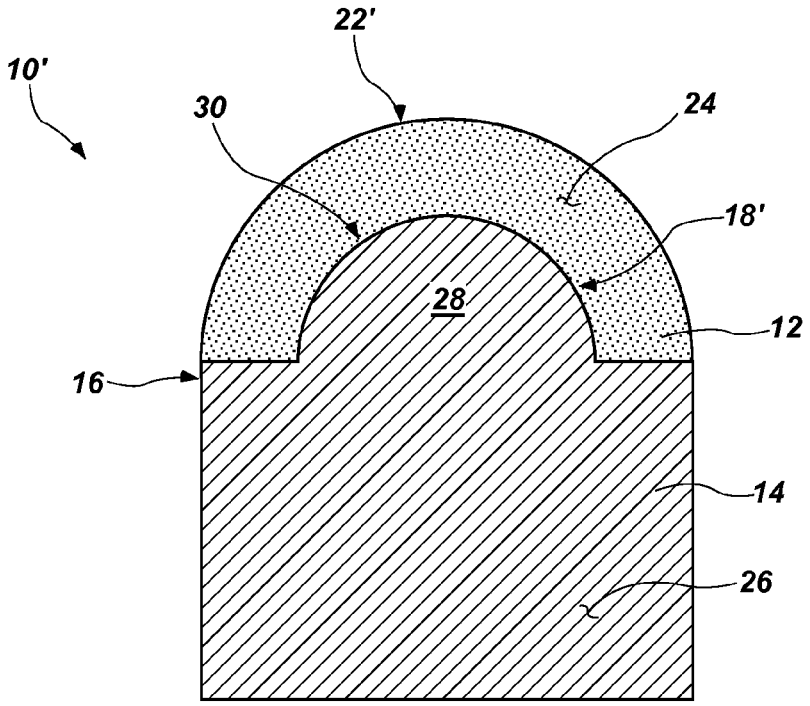
FIG. 2 is a cross-sectional view of another embodiment of a cutting element for an earth-boring tool.

Referring to FIG. 2, a cross-sectional view of another embodiment of a cutting element 10' for an earth-boring tool is shown. A cutting face 22' of such a cutting element 10' may be configured to engage and remove an underlying earth formation primarily by a gouging or crushing cutting action. For example, the cutting face 22' may comprise a dome shape (e.g., a hemisphere, a paraboloid of revolution, or a half-ovoid). In other embodiments, suitable cutting faces may comprise other shapes, which may be configured to engage and remove an underlying earth formation primarily by a shearing or scraping cutting action or by a gouging or crushing cutting action, such as, for example, chisel shapes, pointed shapes, cone shapes, tombstone shapes, and other shapes for cutting faces known in the art.

An interface 18' between the cutting table 12 and the substrate 14 may be non-planar in some embodiments, which may increase a strength of the attachment of the cutting table 12 to the substrate 14. For example, the substrate 14 may include at least one protrusion 28 and the cutting table 12 may include at least one recess 30 into which the protrusion 28 may be at least partially inserted. As a specific, non-limiting example, the protrusion 28 may be dome-shaped and may extend from the end 16 of the substrate 14, and the recess 30 may be correspondingly dome-shaped and conform to the contour of the protrusion 28. As other examples, the substrate 14 may include at least one recess and the cutting table 12 may include at least one protrusion at least partially inserted therein or the substrate 14 may include at least one recess and at least one protrusion and the cutting table 12 may include at least one corresponding protrusion and at least one corresponding recess, respectively. Such non-planar interface features may be in any configuration known in the art. Features of the interface 18' may be configured to increase the degree of self-sharpening of the cutting element 10' as the cutting edge 19 (see FIG. 6) wears and chips away as compared to a cutting element 10 lacking such a non-planar interface 18'. Suitable non-planar interfaces 18' that may be so configured are disclosed in U.S. patent application Ser. No. 13/165,145, filed Jun. 21, 2011, to Scott et al., the disclosure of which is incorporated herein in its entirety by this reference. For example, such a non-planar interface 18' may include a feature extending into the cutting table 12, which may cause the cutting table 12 to chip or otherwise break away after wearing to a certain extent.

Figure 3:
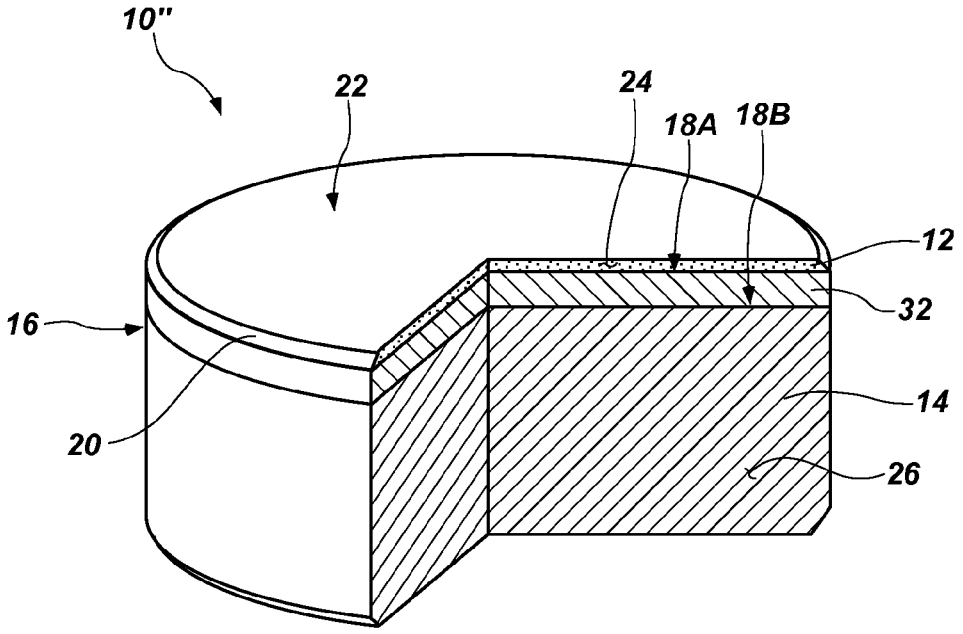
FIG. 3 is a partial cutaway perspective view of another embodiment of a cutting element for an earth-boring tool.

Referring to FIG. 3, a partial cutaway perspective view of another embodiment of a cutting element 10" for an earth-boring tool is shown. In some embodiments, an intermediate material 32 may be interposed between the cutting table 12 and the substrate 14. For example, the intermediate material 32 may be bonded directly to the cutting table 12 at a first interface 18A and bonded directly to the substrate 14 at a second, opposing interface 18B. In some embodiments, the first interface 18A, the second interface 18B, or both may include at least one non-planar interface feature. The intermediate material 32 may increase the strength of the bond between the cutting table 12 and the substrate 14, as compared to the strength of the bond in a cutting element lacking the intermediate material 32, may reduce an extent to which material 26 of the substrate 14 is swept into the cutting table 12 during attachment of the cutting table 12 to the substrate 14, or both. For example, the intermediate material 32 may comprise Ta, W, or both. As specific, non-limiting examples, the intermediate material 32 may comprise Ta when the substrate 14 comprises Ti or a Ti alloy, or the intermediate material 32 may comprise W when the substrate 14 comprises CoCr, CoCrMo, or CoCrW.

Figure 4:
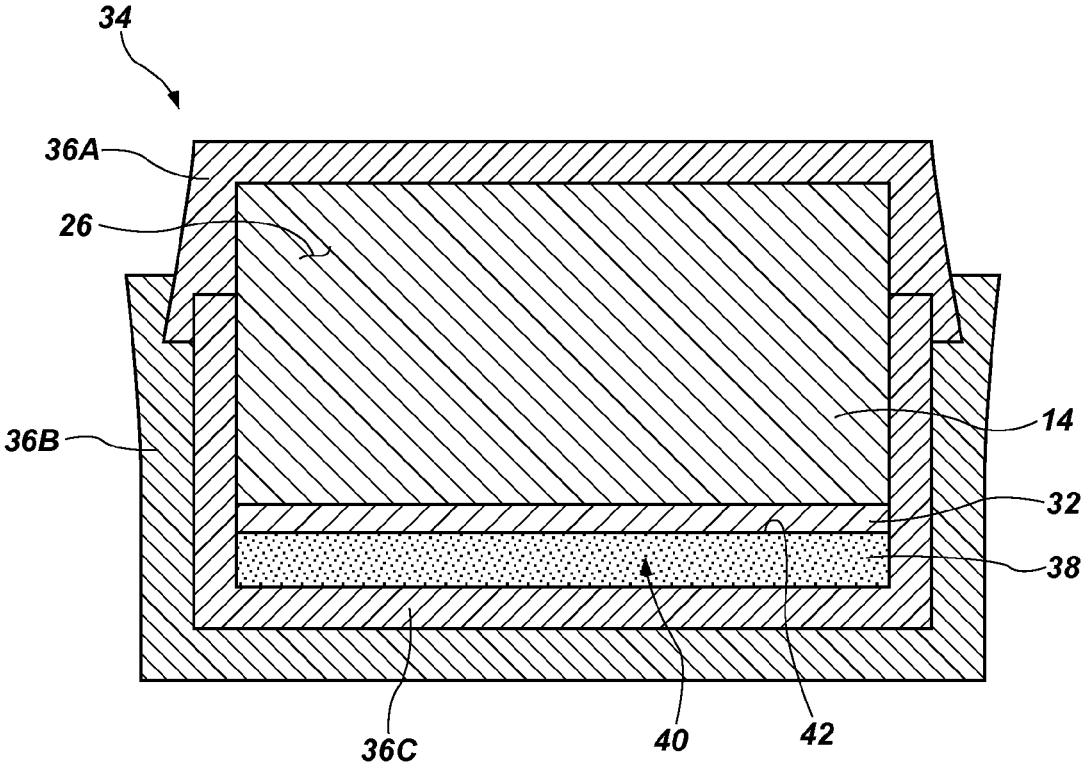
FIG. 4 is a cross-sectional view of a container for forming a cutting element.

Referring to FIG. 4, a cross-sectional view of a container 34 for forming a cutting element 10 (see FIG. 1) in an HTHP process is shown. The container 34 may include one or more generally cup-shaped members, such as cup-shaped member 36A, cup-shaped member 36B, and cup-shaped member 36B, which may be assembled and swaged, welded, or swaged and welded together to form the container 34. The cup-shaped members 36A through 36C may be shaped to impart a desired shape to the resulting cutting element 10, 10', 10" (see FIGS. 1 through 3), such as, for example, any of those cutting element shapes described previously herein. The container 34 may be used to form a cutting element 10, 10', 10" (see FIGS. 1 through 3). When forming a cutting element 10, 10', 10" in the container 34, a substrate 14 may be disposed in the container 34. The substrate 14 may comprise any of the materials 26 described previously herein. The substrate 14 may have been fully formed (e.g., may exhibit its final density) prior to its placement into the container 34 in some embodiments. For example, the substrate 14 may be formed by sintering particles of its material 26 to a final density, may be formed by casting the material 26, or may be formed by machining the material 26 into the substrate 14. In other embodiments, particles of the material 26 of the substrate 14 may be placed in the container 34, and the substrate 14 may be formed concurrently with the cutting element 10, 10', 10".

Particles of superabrasive material 38 may be disposed in the container 34. The particles of superabrasive material 38 may comprise, for example, diamond grains, particles of cubic boron nitride, or particles of other superabrasive materials known in the art. The particles of superabrasive material 38 may exhibit a monomodal or a multimodal (e.g., bimodal, trimodal, etc.) particle size distribution, may be distributed such that different regions of the particles of superabrasive material 38 within the container 34 comprise different average particle sizes, and may exhibit a gradient in average particle size passing through different regions of the particles of superabrasive material 38 within the container 34. In some embodiments, a catalyst material 40, which may catalyze formation of particle-to-particle bonds among the particles of superabrasive material 38, may be dispersed among the particles of superabrasive material 38 in the container 34. For example, powdered catalyst material 40 may be admixed with the particles of superabrasive material 38 and the resulting mixture of particles may be disposed in the container 34. The catalyst material 40 may comprise, for example, Co, Fe, Ni, alloys and mixtures thereof, or other catalyst materials 40 known in the art. In other embodiments, catalyst material may be swept from the substrate 14 among the particles of superabrasive material 38 to catalyze formation of particle-to-particle bonds among the particles of superabrasive material 38. For example, where the material 26 of the substrate 14 comprises CoCr, CoCrMo, or CoCrW, the material 26 of the substrate 14 (e.g., the Co constituent of the material 26) may catalyze formation of particle-to-particle bonds among the particles of superabrasive material 38.

In some embodiments, an intermediate material 32 may be disposed in the container 34 between the substrate 14 and the particles of superabrasive material 38. For example, a layer 42 (e.g., a foil) of the intermediate material 32 may be located between the substrate 14 and the particles of superabrasive material 38 in the container 34. In other embodiments, the substrate 14 may abut the particles of superabrasive material 38 directly, there being no intermediate material 32 interposed therebetween.

The particles of superabrasive material 38 may be sintered with the substrate 14 in the container 34 to form a polycrystalline superabrasive material 24 (see FIGS. 1 through 3) attached to the substrate 14. For example, the contents of the container 34 (e.g., the substrate 14 or material 26 for forming the substrate 14, the particles of superabrasive material 38, and the optional intermediate material 32) may be subjected to an HTHP process for forming the polycrystalline superabrasive material 24. Such an HTHP process may involve exposing the contents of the container 34, including the particles of superabrasive material 38, to a temperature of at least 1320° C. and a pressure of at least 5 GPa. For example, the contents of the container 34 may be exposed to a temperature of about 1500° C. and a pressure of about 7 GPa, though the precise temperature, pressure, and duration may vary. In some embodiments, the peak pressure to which the contents of the container 34 may be exposed may exceed 8 GPa. When the contents of the container 34 are exposed to such elevated temperatures and pressures, metallic materials, such as, for example, the material 26 or at least a portion of the material 26 of the substrate 14, the optional intermediate material 32, and the optional catalyst material 40, may plasticize (e.g., liquefy), may be swept among the particles of superabrasive material 38, and may form attachments (e.g., chemical bonds and mechanical interferences) with the particles of superabrasive material 38. Formation of direct particle-to-particle bonds among the particles of superabrasive material 38 may be catalyzed (e.g., by the material 26 of the substrate 14 or by the catalyst material 40), and the polycrystalline superabrasive material 24 (see FIGS. 1 through 3) may be formed as the particles of superabrasive material 38 are sintered. The resulting cutting element 10, 10', 10" (see FIGS. 1 through 3) may optionally be subjected to finishing processes (e.g., grinding and polishing) and attached to an earth-boring tool.

For example, the substrate 14 may plasticize, catalyst material from the material 26 of the substrate 14 may be swept among the particles of superabrasive material 38, direct particle-to-particle bonds may form among the particles of superabrasive material 38 to form a polycrystalline superabrasive material 24 (see FIGS. 1 through 3), and the polycrystalline superabrasive material 24 may be attached to the substrate 14, for example, by bonding to the adjacent material 26 of the substrate 14 and by mechanical interference between the polycrystalline superabrasive material 24 and the material 26 of the substrate 14 that has been swept among the particles 38 (e.g., in interstitial spaces among the particles 38) that have interbonded to form the polycrystalline superabrasive material 24. As another example, the substrate 14, the optional intermediate material 32, and the optional catalyst material 40 may plasticize, the optional intermediate material 32 may reduce an extent to which the material 26 of the substrate 14 is swept among the particles of superabrasive material 38 (e.g., may prevent the material 26 of the substrate 14 from sweeping among the particles of superabrasive material 38), direct particle-to-particle bonds may form among the particles of superabrasive material 38 to form a polycrystalline superabrasive material 24 (see FIGS. 1 through 3), and the polycrystalline superabrasive material 24 may be attached to the substrate 14, for example, by bonding to the adjacent intermediate material 32, which may be bonded to the substrate 14, and by mechanical interference between the polycrystalline superabrasive material 24 and the intermediate material 32 that has been swept among the particles 38 (e.g., in interstitial spaces among the particles 38) that have interbonded to form the polycrystalline superabrasive material 24.

In some embodiments, at least some material located in interstitial spaces among interbonded particles 38 of the polycrystalline superabrasive material 24 may be removed. For example, material 26 of the substrate 14 that has swept into the interstitial spaces, intermediate material 32 that has swept into the interstitial spaces, or catalyst material 40 located in the interstitial spaces may be removed from all or a portion of the polycrystalline superabrasive material 24. For example, leaching processes known in the art may be used to remove material located in the interstitial spaces from regions of the polycrystalline superabrasive material 24 at and near the cutting face 22, 22' (see FIGS. 1 through 3) of the cutting element 10.

Figure 5:
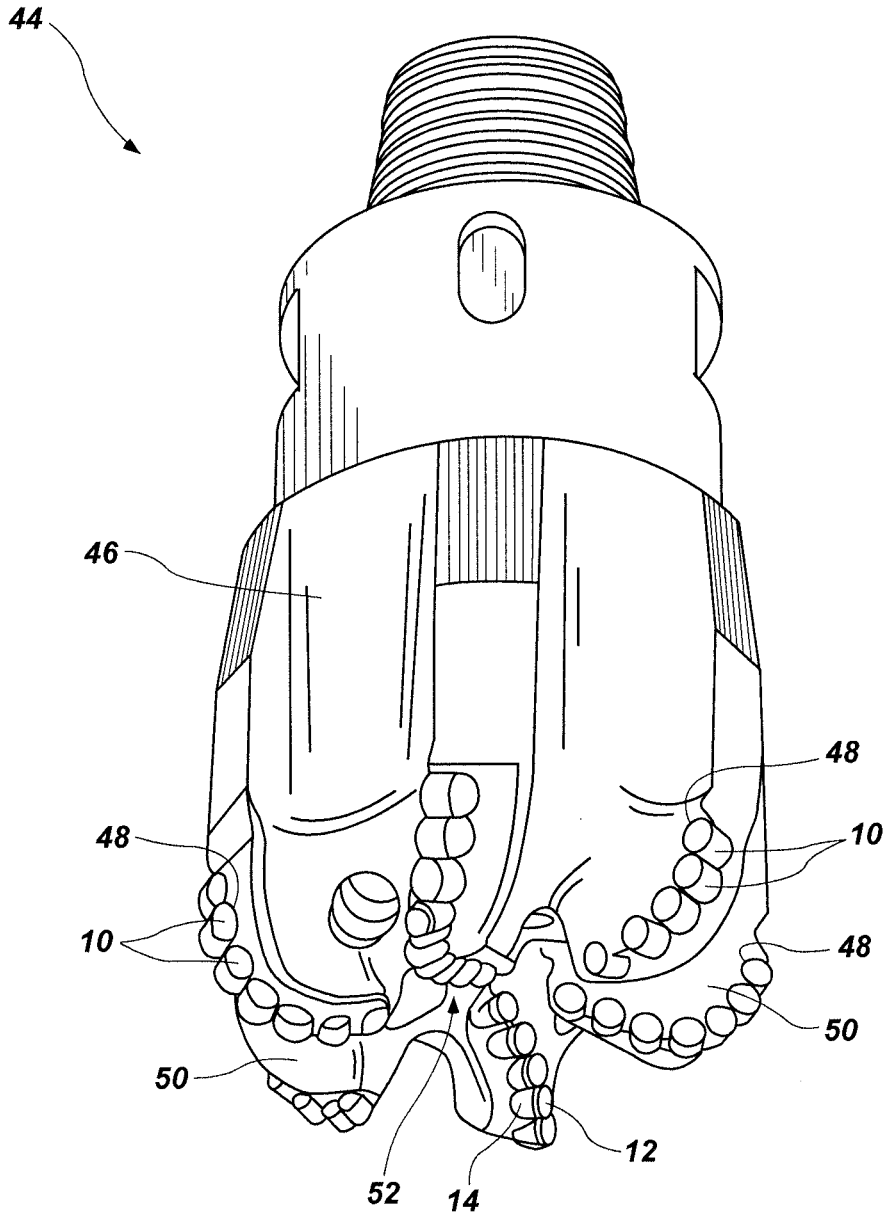
FIG. 5 is a perspective view of an earth-boring tool.

Referring to FIG. 5, a perspective view of an earth-boring tool 44 is shown. The earth-boring tool 44 may comprise a body 46 and at least one cutting element 10 (e.g., any of the cutting elements 10, 10', and 10" described previously in connection with FIGS. 1 through 3) attached to the body 46. For example, many cutting elements 10 may be attached to the body 46 by brazing, welding, mechanical interference, or any combination of these, or other methods for attaching cutting elements to bodies of earth-boring tools known in the art. In some embodiments, the substrate 14 of such cutting elements 10, 10', or 10" may be particularly suitable for a variety of welding attachment processes. As a specific, non-limiting example, the body 46 may comprise steel and at least one cutting element 10 may be secured to the body 46 by welding. The earth-boring tool 44 may comprise, for example, a fixed-cutter earth-boring drill bit and the body 46 may comprise a steel bit body of the fixed-cutter earth-boring drill bit. The cutting elements 10 may be secured within pockets 48 formed in blades 50 extending from a face 52 of the body 46. In other embodiments, the cutting elements 10 may be secured to a face of a blade 50 (i.e., not within pockets 48) by any suitable process, such as, for example, welding or brazing. As other examples, suitable earth-boring tools to which the cutting elements 10 may be attached may include roller cone bits, percussion bits, core bits, eccentric bits, bicenter bits, hybrid bits, reamers, mills, and other earth-boring tools known in the art. The bodies of such earth-boring tools may include, for example, bit bodies, roller cones, fixed blades, extendable blades, and other portions of the earth-boring tools to which cutting elements 10 may be attached and may comprise metal, metal alloys (e.g., steel), or particle-matrix composite materials (e.g., cobalt-cemented tungsten carbide).

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one disclosed embodiment may be combined with features of another disclosed embodiment while still being encompassed within the scope of embodiments of the invention as contemplated by the inventor.

What is claimed is:

1. A cutting element for an earth-boring tool, comprising:

a cutting table comprising a polycrystalline superabrasive material, the cutting table comprising an at least substantially planar cutting face; and a substrate attached to the cutting table, the substrate comprising at least one metal or metal alloy material selected from the group consisting of CoCr, CoCrMo, CoCrW, wherein a wear rate of the substrate is faster than a wear rate of a similarly configured substrate comprising cobalt-cemented tungsten carbide, and wherein the substrate is at least substantially free of particle-matrix composite material.

2. The cutting element of claim 1, further comprising an intermediate material interposed between the substrate and the cutting table.

3. The cutting element of claim 2, wherein the intermediate material comprises at least one of Ta and W.

4. The cutting element of claim 1, wherein the cutting table is attached directly to the substrate.

5. The cutting element of claim 1, wherein the substrate at least substantially comprises the metal or metal alloy material selected from the group consisting of CoCr, CoCrMo, CoCrW.

6. The cutting element of claim 5, wherein the substrate is at least substantially free of tungsten carbide.

7. The cutting element of claim 1, wherein an interface between the cutting table and the substrate is nonplanar.

8. The cutting element of claim 1, wherein at least a portion of the cutting table at and proximate the cutting face is at least substantially free of catalyst material used to form the cutting table.

9. An earth-boring tool, comprising:

a body; and at least one cutting element attached to the body, the at least one cutting element comprising:

a cutting table comprising a polycrystalline superabrasive material, the cutting table comprising an at least substantially planar cutting face; and a substrate attached to the cutting table, the substrate comprising at least one metal or metal alloy material selected from the group consisting of CoCr, CoCrMo, CoCrW, wherein a wear rate of the substrate is faster than a wear rate of a similarly configured substrate comprising cobalt-cemented tungsten carbide, and wherein the substrate is at least substantially free of composite material.

10. The earth-boring tool of claim 9, wherein the polycrystalline superabrasive material is at least substantially free of particle-matrix composite material.

11. The earth-boring tool of claim 9, wherein at least a portion of the cutting table at and proximate the cutting face is at least substantially free of catalyst material used to form the cutting table.

12. The earth-boring tool of claim 9, wherein the body comprises steel and wherein the at least one cutting element is welded to the body.

13. A method of forming a cutting element for an earth-boring tool, comprising:

disposing a substrate comprising at least one metal or metal alloy material selected from the group consisting of CoCr, CoCrMo, CoCrW in a container;

disposing particles of superabrasive material in the container; and sintering the particles of superabrasive material with the substrate in the container to form a cutting table comprising a polycrystalline superabrasive material, the cutting table comprising an at least substantially planar cutting face, the cutting table attached to the substrate, wherein a wear rate of the substrate is faster than a wear rate of a similarly configured substrate comprising cobalt-cemented tungsten carbide, and wherein the substrate is at least substantially free of particle-matrix composite material.

14. The method of claim 13, further comprising disposing an intermediate material between the substrate and the particles of superabrasive material in the container.

15. The method of claim 14, further comprising selecting the intermediate material to comprise at least one of Ta and W.

16. The method of claim 13, wherein sintering the particles of superabrasive material with the substrate in the container to form the polycrystalline superabrasive material attached to the substrate comprises attaching the polycrystalline superabrasive material directly to the substrate.

17. The method of claim 13, further comprising selecting the substrate to substantially comprise the metal or metal alloy material selected from the group consisting of CoCr, CoCrMo, CoCrW.

18. The method of claim 13, further comprising removing catalyst material used to form the cutting table from at least a portion of the cutting table at and proximate the cutting face.

19. The method of claim 13, wherein sintering the particles of superabrasive material with the substrate in the container comprises exposing the particles of superabrasive material with the substrate in the container to a temperature of at least 1350° C. and a pressure of at least 5 GPa.

20. The method of claim 13, wherein sintering the particles of superabrasive material with the substrate in the container comprises sweeping a catalyst material from the substrate among at least some particles of the particles of superabrasive material.

21. The method of claim 13, further comprising dispersing a catalyst material among the particles of superabrasive material in the container.

* * * * *